United States Patent [19]

Hogue et al.

[11] Patent Number: 5,011,529

[45] Date of Patent: Apr. 30, 1991

[54] CURED SURFACES AND A PROCESS OF CURING

[75] Inventors: Kathryn E. Hogue, Corning; Srinivas H. Swaroop; Raja R. Wusirika, both of Painted Post, all of N.Y.

[73] Assignee: Corning Incorporated, Corning, N.Y.

[21] Appl. No.: 323,291

[22] Filed: Mar. 14, 1989

[51] Int. Cl.[5] ..... C22C 29/12

[52] U.S. Cl. ..... 75/235; 75/232; 419/2; 419/19; 428/469; 428/472.2; 428/539.5

[58] Field of Search ..... 419/2, 19; 75/235, 232; 428/539.5, 469, 472.2

[56] References Cited

U.S. PATENT DOCUMENTS

| | | | |
|---|---|---|---|
| 3,969,082 | 7/1976 | Cairns et al. . | |
| 4,247,422 | 1/1981 | Davies | 252/465 |
| 4,283,465 | 8/1981 | Morimoto et al. | 428/566 |
| 4,582,677 | 4/1986 | Sugino et al. | 419/2 |
| 4,758,272 | 7/1988 | Pierotti et al. | 75/246 |
| 4,784,984 | 11/1988 | Yamanaka et al. | 502/439 |
| 4,885,269 | 12/1989 | Cyron et al. | 502/439 |

FOREIGN PATENT DOCUMENTS 0284804 10/1988 European Pat. Off. .

*Primary Examiner*—Brooks H. Hunt
*Assistant Examiner*—Leon Nigohosian, Jr.
*Attorney, Agent, or Firm*—Richard N. Wardell

[57] ABSTRACT

A cured sintered porous metal structure comprising aluminum and aluminum alloys is presented comprising an aluminum oxide durable surface integral to the structure. The surface layer is enhanced in aluminum while the underlying structure is thereby depleted in aluminum. The structure exhibits surface and interfacial durability.

15 Claims, 1 Drawing Sheet

CURED SURFACES AND A PROCESS OF CURING

BACKGROUND OF THE INVENTION

This invention is directed to maturing the surfaces of porous metal powder structures to prolong the life of the surface and the underlying structure. Bodies comprised of sintered porous metal bodies can be advantageously used as filters for fluids, such as diesel particulate filters or molten metal filters, substrates for catalysts, such as for automotive, DeNOx, and woodstove combustor applications, as structural building materials, and generally for structures to support needs for high surface area stable surfaces.

Commonly, such structures are combined with catalysts, such as the base metals and/or noble metals, to be introduced into troublesome effluents that must be converted into some other chemical species. Typically, the method of use is accomplished by putting the structure in the exhaust pathway of either organically fueled power plants or in the exhaust pathway of internal combustion engines.

U.S. Pat. No. 4,758,272 discloses a family of one of the compositions contemplated hereunder, and is incorporated herein by reference for all that is disclosed therein. In that inventive effort an iron aluminum alloy was sintered into a hard porous body. In copending U.S. patent application Ser. No. 219,986 filed July 15, 1988, another composition is disclosed. That disclosure is incorporated herein by reference, as filed. In copending U.S. patent application Ser. No. 273,214 now abandoned filed Nov. 18, 1988, an oxide surface is discussed. That disclosure is incorporated herein by reference, as filed.

That various metal powder structures can be batched, extruded and subsequently sintered into hard porous bodies is a technical achievement. For purposes of durability, however, the bodies from these kind of structures must be additionally treated to provide along lived durable product. As used in the proposed environment, bald sintered surfaces of the subject substrates were found to degrade. This is a disadvantage for a number of reasons, not, the least of which is that the surface on the bald sintered structures can be the interface between costly catalysts and the high surface area structure. Should that interface degrade, the catalyst/substrate system would fail.

The present invention is directed to curing the surface of sintered metal powder porous bodies. The curing a controlled densification and oxidation of the surface layer. This surface layer can be up to a couple of microns thick, most preferably from 0.5 to 1 micron. It is important to understand that controlled densification is defined as directed to the oxide layer only. This densified layer provides durability to the surface, but does not subtract from the porosity of the structure. This important feature provides the structure with the porosity common to a high surface area substrate and adds long life consistent with commercial needs.

Advantageously, the curing process results in an oxide film, durable as a protective coating for the underlying structure. Perhaps as significantly, this protective coating provides a durable high surface area interface integral with the underlying structure that is capable of binding various catalysts. A system so formed may then be placed in harsh environments with an added level of confidence that the system will survive.

Essentially, the final structure of the present invention is a synthesis between a metal core and a ceramic outer layer. The prior work in this field contains either a ceramic high surface area substrate or a contorted metal foil subsequently layered with a high surface area coating. The invention, herein, supplants both of these technologies with a porous metal core intimately integral to a high surface area durable surface.

SUMMARY OF THE INVENTION

In the practice of this invention, a durable surface is provided to sintered hard porous bodies. These bodies are comprised of metal powder that has been batched, extruded, formed in some manner, such as into a honeycomb shape, and subsequently fired to high temperatures forming a hard structure. The honeycomb structure can be formed from 25 to 2400 cells per square inch. The composition comprises iron aluminum alloys, aluminide combined with some transition or rare earth metal, steels and their alloys, and essentially any metal powder form capable of being sintered and subsequently treated to form a durable oxide surface.

The preferred powder material and structure contains an aluminum derived species. Aluminum oxide is the wart and the wish of this sintered porous structure. Aluminum forms a very stable oxide surface, alumina, which makes the powder difficult to impossible to sinter. On the other hand, once sintered it is highly desirable to provide the structure with the alumina surface since the aluminum oxide provides a sturdy durable layer. Compositions of interest are iron aluminum and their alloys comprising 5–60 weight percent aluminum. Substitutions of chromium, nickel, cobalt, titanium, manganese, silicon, copper, molybdenum, niobium, tantalum, and combinations thereof and therebetween for and with the iron constituent of the iron aluminum composition are effected with similar results. In similar manner, aluminum is advantageously combined with any of the rare earth metals and other metals, such as Y, Sc, Zr, Hf, their alloys, and combinations thereof and therebetween. The most preferred composition of the structural body contained about 23 weight percent aluminum, regardless of the combination and/or alloy.

Interestingly for the iron aluminum alloy composition, once the sintered structure is cured the nominal composition of the structure may be transformed. This transformation obtains from the nominal composition of the batched material, into a transformed cured nominal composition. At the curing temperatures and in the curing atmospheric environment, it is speculated that the aluminum component is thermodynamically and kinetically favored to oxidize. At about 1000° C. the alloy structure, while not deforming, is somewhat open to the migration of alloy constituents.

It is further speculated that oxidizing agents which favor aluminum oxidation encourage the migration of aluminum to the surface of the structure. For example, aluminum migration may occur toward the surface of the structure to react with the oxidizing agent. In this manner, the interior portions or nominal bulk concentration of the structure is partially depleted in aluminum. In complementary fashion, aluminum is partially enriched on the surface. When cured, this enables the formation of the stable aluminum oxide layer, or alumina, and inhibits the formation of a less stable metal oxide. An additional benefit to this migration is that the refractoriness of the interior alloy may actually increase over the prior batched nominal composition. This result is further enhanced by the production of a highly refractory alumina layer. The end result is a stable layer/-structure.

Certain impurities in the as sintered structure may interfere with the production of the stable oxide layer, depending upon the nominal composition. In the iron aluminum system, excessive carbon residuals in the sintered structure inhibit the production of a well formed layer. The structure may degrade before a suitable oxide layer is formed. In particular, an iron aluminum carbide is formed which may produce acetylene. Preferably, residual carbon of less than 0.6 weight percent should be present, most preferably less than 0.2 weight percent residual carbon should be present.

The presence of residual oxygen in the as sintered structure may interfere with the production of a stable oxide layer, depending upon the nominal composition. In the iron aluminum system, less than 1.8 percent residual oxygen is preferred, and less than about 1.0 percent residual oxygen is most preferred. Residual oxygen is defined as oxygen bound within the structure as an oxide, not part of any controlled oxide layer.

This invention is usefully directed to a durable surface without interfacial meaning. The invention is also directed to a durable interface whereby the interface is stable and generally of high surface area. Additionally, this integral interface does not become the limiting factor in the durability of the system as employed in its ultimate harsh environment. As can be understood by those skilled in this art, an integral interface is a well defined layer that is in wedlock with its underlying structure. The growth of the layer is purposely induced and owes its life to the structure, not merely being an add on coating or artifact of the sintering process.

Finally, this invention is directed to a process to manipulate the surface of these structures to provide the preoxidized durable interface and/or surface feature. In the practice of the invention, a powder mixture must be sintered avoiding production of oxide surfaces during the sintering or firing cycle. Once thus formed the sintered body is either a reduced form of the metal or comprises some fragile surface that is susceptible to spalling or degradation. Therefore, it has been discovered that a controlled growth oxide surface is required to prolong the life and add other properties to this novel structure. The heart of this process is the order in which the oxide is formed. Oxide formation is at first inhibited only to be ultimately encouraged in the final product.

This oxidation process can be made to occur in air, hydrogen/water mixture, carbon dioxide, or a controlled oxygen atmosphere from a temperature of about 950° up to 1350° C. The air atmosphere is preferred. The preferable oxidation temperature range is from about 1000° to about 1150° C. Oxidizing in a controlled atmosphere under about 1150° C. has a distinct commercial advantage, since production kilns operate at about or below this temperature. Operating at temperatures above this range encumbers the ability to mass produce structures of this kind. Insertion of the already sintered structure within the kiln may occur either by plunge insertion into an "at temperature" kiln, to rapidly fire the surface. Or, alternatively, by rapidly changing the atmosphere from inert and/or reducing to oxidizing. The rate of firing will depend upon the nominal composition since the chosen rate should favor the formation of aluminum oxide at the surface.

The system, as herein defined, means the underlying structure, the interfacial and/or durable surface, and any overlying coating with or without a catalyst contacting the before said surface. A preoxidized durable surface, as herein defined, means that surface without the overlying coating, said durable surface exists as a means to protect the underlying structure. A preoxidized durable interface feature is defined as that surface wherein a substrate is underlying and a coating is overlying, both in contact with the interfacial feature.

Various catalyst systems can be incorporated at, withon and within the preoxidized porous durable interface feature, usually by application of a coating. The catalyst systems may at times be in intimate contact with the underlying structure, due to the porosity of that structure. Open porosity can be within the range of 20 to 60%.

In the main, however, the catalysts applied to the interface feature are vicinal to the preoxidized interfacial surface contacting binding sites or associations on and throughout that surface. Additionally, catalysts may be contained in a washcoat whereby the washcoat contacts the interfacial surface or some combination of contact between washcoat, catalyst, and interfacial surface. Catalysts incorporated by such a structure can be derived from the metals found in the transition metal series of elements, such as chromium, molybdenum, vanadium, titanium, cobalt, and nickel and their oxides, to name a few. Or the catalysts may be derived from the noble metal catalysts, examples of which are platinum, palladium, rhodium, and silver. Other catalytic means may also be incorporated to be vicinal to the preoxidized interface. These catalysts are derived from molecular sieves or zeolites such as ZSM-5, ZSM-8, ZSM-11, ZSM-12, HL powder, beta-zeolites, silicalite, and combinations thereof.

Additionally, a washcoat derived from an alumina source can be advantageously situated at, within and withon the preoxidized interface. Since the preoxidized interface is oxidized aluminum, that interface is comprised of alumina. It is a familiar maxim of chemistry that like dissolves like. In the case of alumina washcoats the interfacial energies of washcoat and preoxidized interface are similar, therefore the bonding between washcoat and preoxidized interface is very strong and highly associated.

In particular, this invention solves a problem in the contorted metal foil art, since a significant problem exists in that art with regard to the integrity of the interface between foil surface and coating. With the present invention, the preoxidized interface is integral to the underlying substrate while exposing a surface to an alumina based washcoat amenable to strong bonding interactions. However, the present invention is not limited to alumina based washcoats. The surface of the preoxidized interface may acceptably bond to any washcoat that is compatible with the alumina preoxidized interface.

DESCRIPTION OF THE PREFERRED EMBODIMENTS

Figure 1:
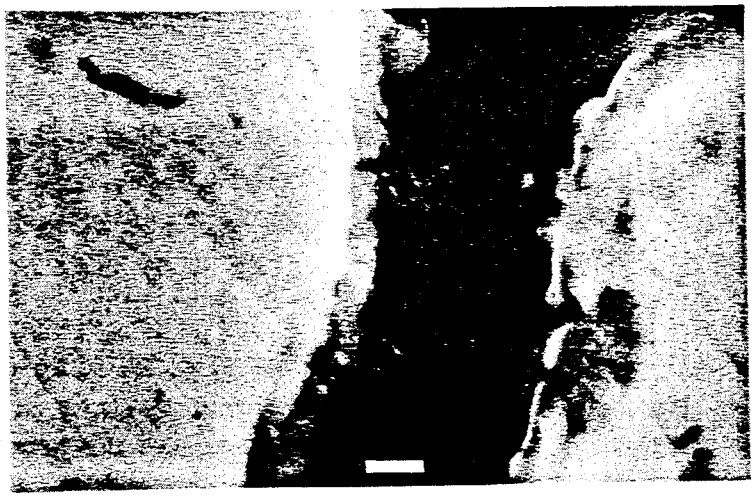
FIG. 1 is an SEM micrograph cross-sectional view of the oxide layer of Example 1.

The following description is directed to the practice of this invention in its preferred embodiments and is not intended to limit either the process whereby the oxide layer is produced nor the materials wherefrom the structures are derived.

Generally, the structures are derived from metal powders commonly available from commercial supply houses. In U.S. Pat. No. 4,758,272 is disclosed a process followed in the practice of this invention in the manufacture of structures. In copending U.S. patent application, Ser. No. 219,986 is an additional process for manufacturing the underlying structure and is the more preferred method of making that structure. Both of these disclosures are herein incorporated by reference for the processes that are therein disclosed.

Example 1 was batched as 72 weight percent −325 mesh iron powder (Hoaeganaes MH-300) and 28 weight percent 50/50 Fe-Al −325 mesh alloy (Shieldalloy) mixture that had been combined with 1 weight percent zinc powder (Cerac), 0.5 weight percent zinc stearate (Witco Regular Grade), 1 weight percent oleic acid (Emersol 213), 6 weight percent methylcellulose (Dow Methocel 20-333) and 15 weight percent deionized water. After batching, extruding, drying, and firing a structure, a 400 cell per square inch honeycomb in this instance, comprised of 14 weight percent aluminum with the remainder substantially iron. The formation of the oxide layer was provided by continued firing of the sample at about 1000° C for 5 hours in air. The sample, once cured was cooled to room temperature. The curing at 1000° C. can be included, as was done with Example 1, as part of the firing process of the structure. Alternately, the samples can be cooled and then refired at about 1000° C. with advantageous results.

Table 1 shows Examples 1–8 and their nominal weight percent compositions after the structure had been sintered. These Examples were produced similar to that of Example 1.

TABLE 1

| | Composition Wt % | | | | |
|---|---|---|---|---|---|
| Example | Fe | Al | RE | Ti | Ni |
| 1 | 86 | 14 | 0 | 0 | 0 |
| 2 | 80 | 20 | 0 | 0 | 0 |
| 3 | 77 | 23 | 0 | 0 | 0 |
| 4 | 0 | 33 | 0 | 0 | 67 |
| 5 | 0 | 63 | 0 | 37 | 0 |
| 6 | 0 | 50 | 0 | 50 | 0 |
| 7 | 0 | 42 | 0 | 58 | 0 |
| 8 | 0 | 24.5 | 75.5 | 0 | 0 |

Table 2 shows the results of durability testing of the cured and uncured samples. Examples 9–13 contain 14 weight percent aluminum. Examples 14–21 contain 23 weight percent aluminum. Cured Examples 13, 15, 17, 19, 21 were cured in air. Cured Example 22 was cured in wet H2 Example 23 was treated with dry $H_2$. From the observed test results, dry $H_2$ is a poor curing agent. The durability or simulated aging tests were conducted to simulate the standard automotive converter aging tests. Test conditions were at about 920° C. for 44 hours, in a simulated auto exhaust atmosphere of 10% moisture, 8% $CO_2$, 1% oxygen and the balance nitrogen, all by volume.

TABLE 2

| Example | Cured | % Weight Gain When Aged | Sample Appearance |
|---|---|---|---|
| 9 | no | 20.0 | poor |
| 10 | no | 20.0 | poor |
| 11 | no | 36.5 | poor |
| 12 | no | 39.2 | poor |
| 13 | yes | 0.75 | excellent |
| 14 | no | 10.98 | deteriorating |
| 15 | yes | 0.57 | excellent |
| 16 | no | 10.82 | deteriorating |
| 17 | yes | 1.93 | excellent |
| 18 | no | 11.0 | deteriorating |
| 19 | yes | 0.93 | excellent |
| 20 | no | 12.0 | deteriorating |
| 21 | yes | 0.83 | excellent |
| 22 | yes | 9.1 | fair |
| 23 | no | 15.7 | poor |

Table 3 shows the results of durability testing of the cured layers that have been coated with a washcoat. Example 24 was cured for 5 hours and Example 25 was cured for 24 hours. Both samples lost a little weight due to water in the washcoat. The washcoat adhered to the samples very well. The washcoat was alumina doped with ceria by the slurry dipping technique, a technique known to those skilled in this art. These samples were then fired at 550° C., then catalyzed with platinum and rhodium, similar to catalytic converters used in automobiles. The results of the simulated aging tests are shown in Table 3.

TABLE 3

| Example | Washcoat | Sample Appearance |
|---|---|---|
| 24 | alumina | excellent |
| 25 | alumina | excellent |

Figure 2:
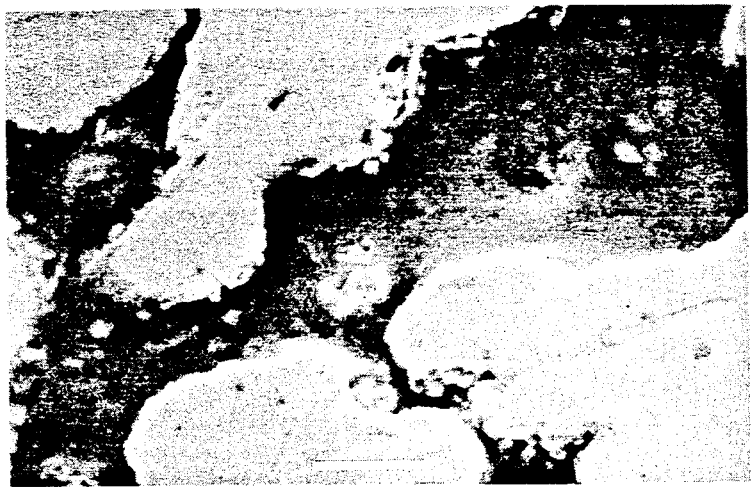
FIG. 2 is an SEM micrograph cross-sectional view of the oxide layer of Example 11.
Figure 3:
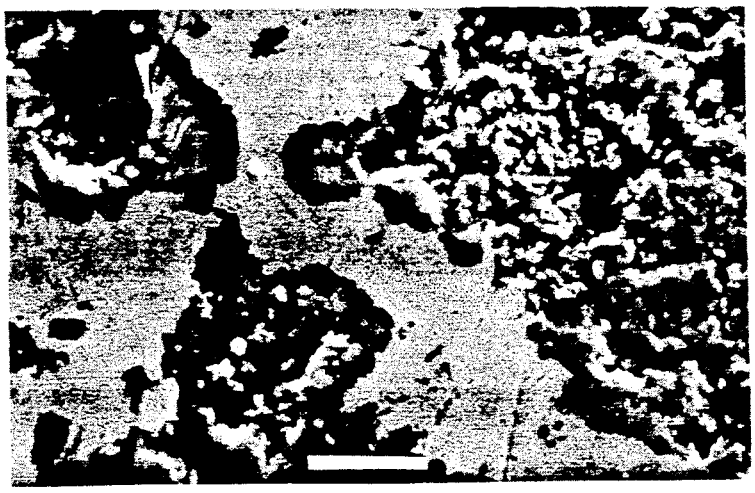
FIG. 3 is an SEM micrograph cross-sectional view of the oxide layer of Example 9.

FIG. 1 shows the SEM cross section of Example 1. This micrograph displays the uniform cured aluminum oxide layer on the substrate. FIG. 2 shows the SEM cross section of Example 11. Example 11 was cured and then aged similarly to that of Example 9. The aging of Example 11 was ineffective, resulting in a protected substrate. FIG. 3 shows the SEM cross section of Example 9. As stated above, Example 9 was not cured and was subsequently aged. Corrosion on the surface and subsurface of the structure is evident.

We claim:

1. A cured porous sintered metal-metal oxide structure comprising sintered aluminum and additional metal powders, wherein said structure has an open porosity of 20–60% and contains a durable uniform cured aluminum oxide layer integral on and throughout said structure.

2. The structure of claim 1, having a nominal composition comprising aluminum and additional metal wherein said layer is partially enhanced with aluminum in an amount greater than and derived from said nominal composition of the part of said structure underlying said layer, resulting in a more refractory structure than the nominal composition.

3. The structure of claim 1, wherein said underlying layer is coated with an overlying coating consisting essentially of a coating selected from the group consisting of base metals and their oxides, noble metals, zeolites, washcoats, molecular sieves, and combinations thereof and therebetween.

4. The structure of claims 1, 2 or 3 wherein said additional metal consists essentially of metals selected from the groups consisting of iron, rare earth metals, chromium, nickel, cobalt, titanium, manganese, silicon, copper, molybdenum, niobium, tantalum, yttrium, scandium, zirconium, hafnium, their alloys, and combinations thereof and therebetween.

5. The structure of claims 1, 2, and 3 wherein said aluminum is present at about 14 weight percent.

6. The structure of claims 1, 2, and 3 wherein said aluminum is present at about 23 weight percent.

7. The structure of claim 2 wherein said layer is enriched in aluminum up to 5% by weight from the aluminum component in the nominal composition.

8. The structure of claims 1, 2 and 3 wherein the thickness of said layer is up to 1 micron.

9. The structure of claims 1, 2, and 3 wherein said layer is alumina.

10. The structure of claim 3 wherein said zeolites are selected from the group consisting of ZSM-5, ZSM-8, ZSM-11, ZSM-12, HL powder, beta-zeolites, silicalite, and combinations thereof.

11. The structure of claim 3 wherein said noble metals are selected from the group consisting of platinum, palladium, silver, rhodium, and combinations thereof.

12. The structure of claim 3 wherein said base metals are selected from the group consisting of molybdenum, vanadium, nickel, chromium, titanium, manganese, copper, and combinations thereof and therebetween.

13. The structure of claim 3 wherein said washcoat is alumina.

14. The structure of claims 1, 2, or 3 wherein said structure is a honeycomb.

15. The structure of claims 1, 2, or 3 wherein said aluminum is 5–60 weight percent of the structure.

* * * * *

UNITED STATES PATENT AND TRADEMARK OFFICE

CERTIFICATE OF CORRECTION

PATENT NO. : 5,011,529

DATED : April 30, 1991

INVENTOR(S) : Kathryn E. Hogue, Srinivas H. Swaroop, Raja R. Wusirika

It is certified that error appears in the above-identified patent and that said Letters Patent is hereby corrected as shown below:

Col. 1, lines 31-32
delete "now abandoned"

Col. 1, line 40
"along" should be "a long"

Col. 1, line 44
delete "," after "not"

Col. 1, line 51
insert "comprises" after "ing"

Col. 5, line 61
"H2" should be "$H_2$"

Col. 6, line 55
there should be a "," after "metal"

Col. 6, line 61
delete "underlying"

Col. 7, line 1
"groups" should be "group"

Col. 7, line 6
"and" should be "or"

Col. 7, line 9
"and" should be "or"

UNITED STATES PATENT AND TRADEMARK OFFICE

CERTIFICATE OF CORRECTION

PATENT NO. : 5,011,529

DATED : April 30, 1991

INVENTOR(S) : Kathryn E. Hogue, Srinivas H. Swaroop, Raja R. Wusirika

It is certified that error appears in the above-identified patent and that said Letters Patent is hereby corrected as shown below:

Col. 7, line 14
"and" should be "or"

Col. 7, line 16
"and" should be "or"

Signed and Sealed this

Ninth Day of February, 1993

*Attest:*

STEPHEN G. KUNIN

*Attesting Officer*

*Acting Commissioner of Patents and Trademarks*